US009010572B2

(12) United States Patent
Demey et al.

(10) Patent No.: US 9,010,572 B2
(45) Date of Patent: Apr. 21, 2015

(54) TIP SEAL HAVING A POSITION INDICATOR, THE TIP SEAL BEING CONFIGURED TO DISPENSE A FOAM SOLUTION

(71) Applicant: Altachem N.V., Deinze (BE)

(72) Inventors: Jordi Demey, Oeselgem (BE); Felix Oeser, Schonberg (DE); Oskar Pittl, Gross Gronau (DE)

(73) Assignee: Altachem N. V., Deinze (BE)

( * ) Notice: Subject to any disclaimer, the term of this patent is extended or adjusted under 35 U.S.C. 154(b) by 0 days.

(21) Appl. No.: 14/181,472

(22) Filed: Feb. 14, 2014

(65) Prior Publication Data

US 2014/0224828 A1 Aug. 14, 2014

Related U.S. Application Data

(63) Continuation-in-part of application No. 13/925,887, filed on Jun. 25, 2013, now Pat. No. 8,844,775.

(30) Foreign Application Priority Data

Dec. 11, 2012 (EP) ..... 12196584

(51) Int. Cl.
*B65D 83/00* (2006.01)
*B67D 3/00* (2006.01)
(Continued)

(52) U.S. Cl.
CPC ..... *B65D 47/12* (2013.01); *B05B 1/3073* (2013.01); *B05B 11/0032* (2013.01); *B67D 7/06* (2013.01);
(Continued)

(58) Field of Classification Search
USPC ..... 222/402.1, 153.01, 546, 549, 522, 523, 222/524, 52, 402.12, 498, 563, 23, 24, 41, 222/47, 495, 520, 525; 220/795, 801, 792; 215/320, 355
See application file for complete search history.

(56) References Cited

U.S. PATENT DOCUMENTS 2,877,918 A * 3/1959 Gardner ..... 222/522
3,168,969 A * 2/1965 Krieps ..... 222/520
(Continued)

FOREIGN PATENT DOCUMENTS

DE 102004003263 A1 * 8/2005
EP 2487120 A1 * 8/2012
(Continued)

OTHER PUBLICATIONS

DE 102004003263 A1—Englisth Translation (Machine Generated) Oct. 29, 2013.*
(Continued)

*Primary Examiner* — J. Casimer Jacyna
*Assistant Examiner* — Benjamin R Shaw
(74) *Attorney, Agent, or Firm* — Workman Nydegger

(57) ABSTRACT

The invention relates to a tip seal (10) for an adapter (1) and such an adapter (1) for a pressurized dispensing container comprising a viscous foamable solution, said adapter (1) comprising a tube (11) in connection with said container and conveying the into foam converted viscous foamable solution towards said tip seal (10), said tip seal (10) comprising a core part (101) with an at least partially open proximal end (101*a*) and at least partially open distal end (101*b*), said core part (101) at least partially being inserted into said tube (11) at said proximal end (101*a*); and a cap part (102) which is movably connected with said core part (101) at said distal end (102*b*) of said core part (101) between an open position and a closed position of said tip seal (10), wherein said cap part (102) comprises a closure element (1021) which is adapted for closing off said at least partially open distal end (101*b*) of said core part (101) in said closed position of said tip seal (10).

17 Claims, 5 Drawing Sheets

(51) Int. Cl.

| | |
|---|---|
| ***B67D 7/06*** | (2010.01) |
| ***B65D 47/00*** | (2006.01) |
| ***B67D 7/56*** | (2010.01) |
| ***B67D 7/22*** | (2010.01) |
| ***B65D 47/12*** | (2006.01) |
| ***B05B 1/30*** | (2006.01) |
| ***B65D 83/20*** | (2006.01) |
| ***B65D 83/30*** | (2006.01) |
| ***B65D 83/34*** | (2006.01) |
| ***B65D 83/14*** | (2006.01) |
| ***B65D 51/00*** | (2006.01) |
| *B05B 11/00* | (2006.01) |

(52) U.S. Cl.
CPC ..... *B65D 83/202* (2013.01); *B65D 83/303* (2013.01); *B65D 83/345* (2013.01); *B65D 83/753* (2013.01); *B65D 51/00* (2013.01)

(56) References Cited

U.S. PATENT DOCUMENTS

| | | | | |
|---|---|---|---|---|
| 3,276,640 | A * | 10/1966 | Kessler | 222/525 |
| 3,572,559 | A * | 3/1971 | Stull | 222/499 |
| 3,606,107 | A * | 9/1971 | Ardito et al. | 222/546 |
| 6,085,947 | A * | 7/2000 | Lien | 222/525 |
| 8,701,945 | B2 | 4/2014 | Hoagland et al. | |
| 2003/0066842 | A1 * | 4/2003 | Aiken et al. | 222/1 |
| 2013/0320044 | A1 | 12/2013 | Hoagland et al. | |
| 2013/0320045 | A1 | 12/2013 | Hoagland et al. | |
| 2014/0048568 | A1 | 2/2014 | Demey et al. | |

FOREIGN PATENT DOCUMENTS

| | | | |
|---|---|---|---|
| WO | 02098762 | | 12/2002 |
| WO | 2012/115841 | A1 | 8/2012 |
| WO | 2012115842 | A1 | 8/2012 |
| WO | 2012/120986 | A1 | 9/2012 |

OTHER PUBLICATIONS

European Search Report for corresponding EP Application No. 12196584 dated May 31, 2013.

Preinterview First Office Action from USPTO in corresponding Application No. 13/925,887 dated Nov. 5, 2013.

European Search Report from Corresponding EP Application No. EP 13 19 6673, dated Mar. 13, 2014.

* cited by examiner

TIP SEAL HAVING A POSITION INDICATOR, THE TIP SEAL BEING CONFIGURED TO DISPENSE A FOAM SOLUTION

FIELD OF THE INVENTION

The present invention relates to a tip seal for an adapter that is configured to be connected to a pressurized dispensing container comprising a viscous foamable solution that is converted into foam when leaving said container, such as polyurethane (PUR) foams. In particular, it concerns such a tip seal that is adapted to dispense said foam and comprises a core part comprising an at least partially open proximal end and at least partially open distal end, wherein said distal end of said core part is adapted to be inserted into said tube, and comprises a cap part which is movably connected with said core part at said distal end of said core part between an open position of said tip seal wherein said foam is dispensable and a closed position of said tip seal wherein said foam is non-dispensable, said cap part comprising at least one dispensing orifice to dispense said foam.

The present invention furthermore also relates to an adapter that is configured be connected to a pressurized dispensing container comprising a viscous foamable solution and a valve adapted to convert said viscous foamable solution into foam comprising such a tip seal. Such an adapter more specifically comprises a lever part which is adapted to be connected with said valve and which is adapted to actuate said valve when being operated, and a tube which at its proximal end is connected to said lever part.

BACKGROUND OF THE INVENTION

Pressurized dispensing containers comprising a viscous foamable product to be dispensed as well as a pressurizing fluid have been in widespread use for a variety of applications. A well-known application are sprayable mounting foams, more specifically polyurethane foams, used in industrial applications as well as by hobbyists for insulating and sealing purposes on windows and doors.

Pressurized dispensing containers of this type typically have a valve arranged on their upper end via which the content of the pressurized dispensing container is discharged when said valve is actuated. On this valve, an adapter is fixed by means of a lever part. This lever part preferably is releasably connected to said valve, for instance by means of a screw connection. This adapter furthermore comprises a tube which at its proximal end thereof is connected to the lever part and is adapted for conveying the formed foam towards its distal end where it is then dispensed.

The problem arising with such pressurized containers comprising a pressurized foamable solution which is converted into a foam when leaving the container at the height of said valve, especially for mounting foams such as polyurethane foams which harden quickly when coming into contact with the environment, is that, because the foam when being out of the container hardens under the influence of the environmental air, the continued use of the content of the container is prevented. Especially for private use, this is a big problem since this often only requires small amounts to be used at a given time, such that initially only a relatively small portion of the container content is consumed and the remaining contents of the container after a certain storage time cannot be used anymore. This spoilage is economically as well as environmentally annoying.

At present, already different tip seals for adapters for pressurized containers containing a viscous foamable solution have been developed to solve the abovementioned problem and to provide the contents of the container fresh and usable as long as possible.

In DE 10 2004 003 263 for instance, a spray system for dispensing aerosol substances including polyurethane foam for window and door frames is disclosed, wherein said spray system has a cylindrical tube with a cap on threaded end with an aperture accommodating a central stopper. The cylindrical tube has a spiral ridge forming a coarse screw thread on its outside diameter, engaging with a sleeve on the end of a reservoir container. The tube is open at its base end and there is a central cylindrical stopper held on three equispaced struts. The end of the stopper fits into a central aperture in a cap with a female thread engaging a male thread on the end of the tube. There is a flange between the coarse thread and the thread for the cap.

In WO 2012/115842, a dispensing device for dispensing compressed fluid from a can through a valve stem of the can. The dispensing device contains a hollow tube defining a channel there-through. A connector is provided defining a conduit there-through that is in fluid communication with the channel of the hollow tube. A plug is located in the channel of the hollow tube that is able to move in the channel of the hollow tube and seal the hollow tube from fluid flow when pressed towards the dispensing end of the hollow tube. A sealed port is located between the inside and the outside of the dispensing device and a flexible and inelastic extension piece is attached to the plug and extends through the channel of the hollow tube and optionally extends through the conduit of the connector then out from the dispensing device through the sealed port and capable of attaching to a can to which the dispensing device is connected.

Both dispensing systems as disclosed above however suffer from the disadvantage that the closure element for closing off the partially open distal end of the hollow tube through which the fluid passes when being dispensed, is located inside and extends substantially throughout the tube forming a hurdle within this tube. This forms a hurdle for fluids to be dispensed that easily polymerize when coming into contact with the outside air, which is for instance the case with polyurethane foam coming into contact with the humidity of the outside air. When such fluids stick to this closure element and polymerize there when coming into contact with the outside air, this hardened substance hinders or even completely blocks passage of further fluid to be dispensed throughout the tube. In the latter case, the unconsumed residue of the substance intended to be dispensed even becomes unusable. Such dispensing systems are thus subjected to the risk of the tube becoming clogged at the height of this closure element.

It is furthermore not clear how clogged tubes of this type of dispensing systems can be cleaned. In each case, the flexible and inelastic extension piece that extends through the channel of the hollow tube of the dispensing system as disclosed in WO 2012/115842 is not rigid enough to break hardened PUR foam obstructing the channel of the hollow tube.

A further disadvantage of such kind of dispensing systems having a closure element inside the tube is that these are not easy to manufacture and require a complex production mould. Especially in WO 2012/115842, a complex dispensing device composed out of a lot of parts is disclosed.

There consequently exists a need to provide a tip seal for an adapter that is configured to be connected to a pressurized container comprising a viscous foamable solution that is converted into foam when leaving said container, said tip seal being less sensitive to obstructions, simple, easy and cheap to manufacture and easy to clean.

SUMMARY OF THE INVENTION

According to a first aspect of the invention there is provided a tip seal according to claim 1.

Since the core part of the tip seal is sealed off from the outside thereof, no obstructions are present inside this core part through which this kind of tip seal is far less sensitive to clogging of the core part thereof.

Such a kind of tip seal furthermore requires a simpler mould to be manufactured allowing a more economical manufacturing process thereof.

A further advantage of the tip seal according to the invention is that, because the tube can be sealed off by means of this tip seal, the effect of post-dripping is solved. Post-dripping is the undesired dripping of foam out of the tube because of the presence of remaining pressure and foam in the tube under the influence of the humidity present in de the environmental air.

Finally, cleaning the adapter with the tip seal can be performed in two ways. A first possibility is to place the adapter by means of its lever part onto a bus containing a dissolvent for the respective hardened foam remnants in the adapter/tip seal. If for instance an adapter with a tip seal having remnants of hardened polyurethane foam in it have to be cleaned, then the adapter with the tip seal has to be placed onto an acetone bus, whereafter this acetone bus has to be opened in order to dissolve the polyurethane foam remnants. A second possibility is to place the pressurized dispensing container straight up and then to loosen some gas such that the hardened foam remnants are blown out of the adapter.

In a preferred embodiment of a tip seal according to the invention, said closure element is formed as an inwardly protruding sealing cap that at least partially extends within said core part when said tip seal is in its closed position.

A further disadvantage of the spray system as described in DE 10 5004 003 263 is that the cap has a threaded end and consequently can completely be screwed off from the cylindrical tube. As a result, such a cap can easily get lost.

It is therefore a further purpose of the invention to provide a spray system having parts that cannot easily get lost.

This purpose of the invention is solved by providing a tip seal according to the invention as disclosed above, wherein said core part comprises a first stop member and said cap part comprises a second stop member, said first and second stop member being designed to cooperate together in such a way that they can stop the movement of said cap part relative to said core part in a direction towards said proximal end of said core part.

Because of the presence of these first and second stop members that stop the movement of the cap part relative to the core part in the direction towards the proximal end of the core part, the cap portion cannot be separated from the core portion and consequently cannot get accidentally lost.

Furthermore, these stop members take care that the cap part is not catapulted away from the core part under the pressure of the foam coming out of the pressurized dispense container throughout the tube.

Finally, these stop members give feedback to the user about the open and the closed position of tip seal.

Said first stop member preferably is located near said distal end of said core part.

More preferably, said first stop member comprises a first stop rim and said second stop member comprises a second stop rim, said first and second stop rim extending around at least part of the circumference of said core part, respectively said cap part, and said second stop rim being designed to hit against said first stop rim.

In a favourable embodiment of a tip seal according to the invention, said core part comprises at least a first movement restriction member and said cap part comprises at least a second movement restriction member, said first and second movement restriction members being designed to cooperate together in such a way that said cap part can only be moved relative to said core part in a direction towards said distal end of said core part when a minimal required force is exerted on said cap part.

These movement restriction members only allowing movement of the cap part relative to the core part in a direction towards the distal end of the core part, take care that it is more difficult to close the tip seal accidentally, for instance when the adapter with its tip seal is brought in into a slot, for instance for filling up wall cavities by means of a polyurethane foam.

Said core part preferably comprises a first movement restriction rim and said cap part comprises a second movement restriction rim, said first and second safety rim extending around at least part of the circumference of said core part, respectively said cap part, wherein said first and second movement restriction rim are configured such that movement of said cap part relative to said core part in a direction towards said distal end of said core part is only possible when a force is exerted on said cap part which is large enough to move said second movement restriction rim over said first movement restriction rim.

In a preferred embodiment of a tip seal according to the invention, said second movement restriction rim and said second stop rim are the same rim.

Preferably, between said first stop rim and said first movement restriction rim of said core part, a groove is arranged extending around at least part of the circumference of said core part, wherein said rim is configured to snap fit into said groove.

In an advantageous embodiment of a tip seal according to the invention, said cap part comprises a proximal end and a distal end, wherein said cap part at said proximal end comprises two or more dispense orifices arranged to dispense said foam.

Providing two or more dispense orifices in this cap part provides in a much more homogeneous outflow of the foam out of the tip seal to obtain an acceptable foam beat.

In an advantageous embodiment of a tip seal according to the invention, said closure element comprises one or more sealing elements that are adapted to seal off said proximal end of said core part.

These sealing elements take care for a better airtightness of the inner side of the core part of the tip seal and the tube of the adapter, such that the contents of the container can remain fresh and usable for an even longer time.

Preferably, said sealing elements comprise one or more sealing rims extending around at least part of the circumference of said closure element.

To enable a user to have a better grip on said cap part of said tip seal according to the invention, and furthermore, if restriction movement members are present, in order to enable said cap part to be moved relative to said body part as described above, said cap part preferably has a ribbed outer surface.

When said foam is polyurethane foam, said core and cap part preferably are manufactured out of polyolefines.

Polyolefines such as polypropylene and polyethylene are preferred materials to be used with polyurethane foams because these materials provide for less adhesion of the polyurethane foam. Since the core part of the tip seal has to be anchored in the tube and is subjected to great pressures of about 700 kPa at room temperature, this core part preferably is manufactured out of stiff polyolefin material, preferably being a stiff polyethylene. Since the cap part has to be able to close off the distal end of the core part and furthermore has to be able to easily glide over this core part, the cap part preferably is manufactured out of a waxier polyolefin material, preferably being polyethylene. Polyethylene furthermore postpones adhesion of polyurethane foam for a slightly longer time.

According to a further aspect of the invention, an adapter is provided that is configured to be connected to a pressurized dispensing container comprising a viscous foamable solution; and a valve adapted to convert said viscous foamable solution into foam, wherein said adapter comprises a lever part which is adapted to be connected with said valve and which is adapted to actuate said valve when being operated, and a tube which at its distal end is connected to said lever part, and wherein said tube at its proximal end thereof is provided with a tip seal according to the invention as described above.

DETAILED DESCRIPTION OF EMBODIMENT(S)

Figure 1A:
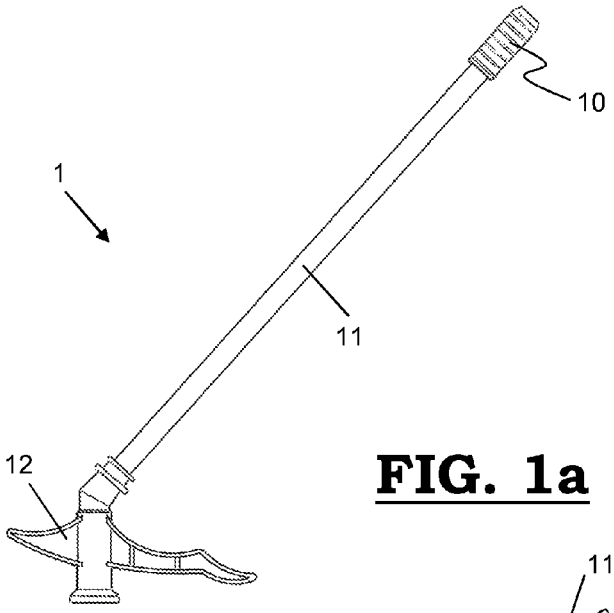
FIG. 1*a* illustrates a front view of a preferred embodiment of an adapter having a first embodiment of a tip seal according to the invention.
Figure 1B:
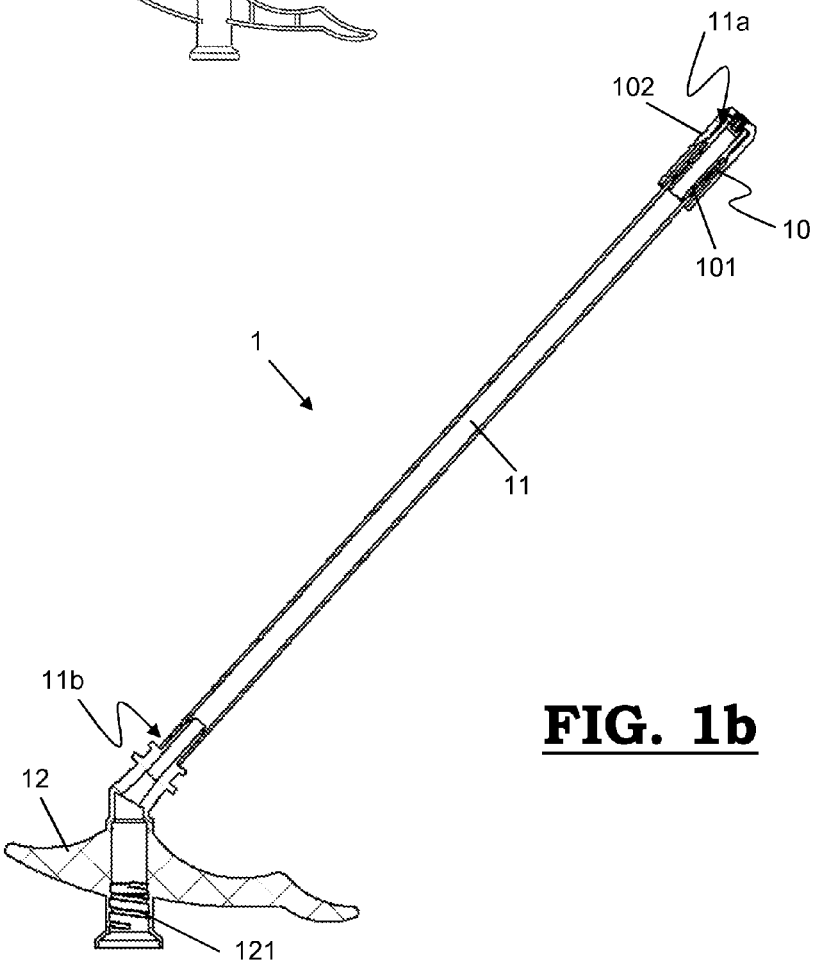
FIG. 1*b* illustrates a cross section of the adapter as shown in FIG. 1*a;*

In FIGS. 1*a* and 1*b*, an adapter (1) is shown that is configured to be connected to a pressurized dispensing container (not shown on the figures) comprising a viscous foamable solution. The pressurized dispensing container furthermore comprises a valve (not shown on the figures) which is adapted to convert the viscous foamable solution into foam. The adapter (1) is provided with a lever part (12) which is adapted to be connected with the valve of the pressurized dispensing container and which is adapted to actuate the valve when the lever part (12) is operated, in this preferred embodiment by tilting it. In order to be able to connect the adapter (1) by means of its lever part (12) to the valve, this preferably in a releasable manner, the valve comprises a stem that is adapted with connection means to connect the lever part (12) of the adapter (1) to it. Preferably, the stem and the lever part (12) are provided with at least one corresponding tread (121) (see FIG. 1*b*) such that the lever part (12) can be screwed on the stem of the valve. The further possible designs of the pressurized dispensing container and its valve are known to the man skilled in the art and will not be described in more detail here.

The adapter (1) further comprises a tube (11), preferably in the form of a hollow cylindrical tube made out of polyethylene, which at its distal end (11*b*) is connected to the lever part (12) and at its proximal end (11*a*) is connected to a tip seal (10). This tube (11) is adapted to convey the formed foam towards the tip seal (10).

Figure 2A:
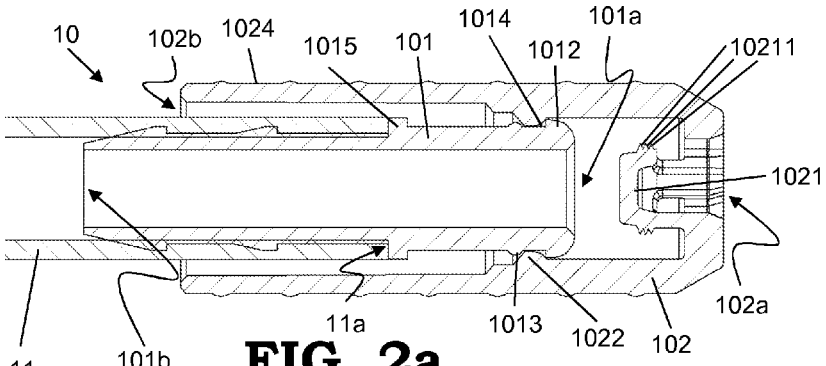
FIG. 2*a* illustrates a cross section of the tip seal of the adapter as shown in FIGS. 1*a* and 1*b* in an open position wherein the foam is dispensable.
Figure 2B:
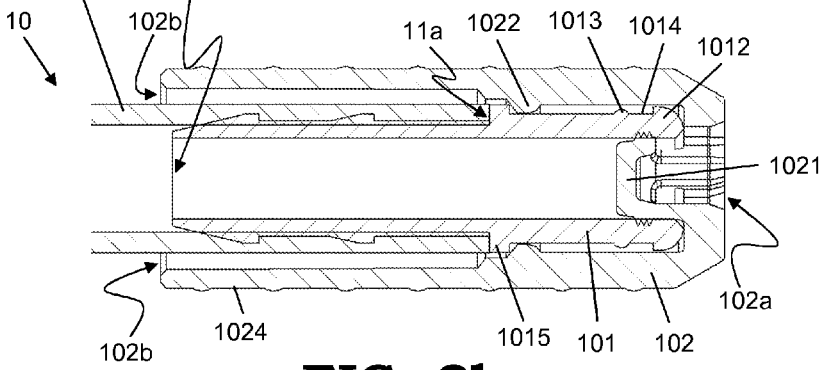
FIG. 2*b* illustrates a cross section of the tip seal of the adapter as shown in FIGS. 1*a* and 1*b* in a closed position wherein the foam is non-dispensable and the closing cap of the cap part closes off the open distal end of the core part.

In FIGS. 2*a* and 2*b*, a tip seal (10) is shown comprising a core part (101), and a cap part (102), both preferably made out of polyolefines.

The core part (101) comprises an at least partially, and in this embodiment completely, open proximal end (101*a*) and an at least partially, and in this embodiment completely, open distal end (101*b*). The distal end (101*b*) of the core part (101) is configured to be inserted into the tube (11). The core part (101) therewith partially extends throughout the inner side of the tube (11). In order to obtain a better anchoring of the core part (101) in the tube (11), as can be seen in FIGS. 2*a* and 2*b*, along the length of the portion of the core part (101) which extends into the tube (11), preferably a number of, in this preferred embodiment of the tip seal (10) two, circumferential anchoring rims (1011) are provided. Furthermore, to stop the movement of the core part (101) into the tube (11), the core part (101) has a rim (1015) extending around the circumference of the core part (101). The proximal end (11*a*) of the tube (11) then abuts against this rim (1015).

The cap part (102) preferably has a ribbed outer surface (1024). This cap part (102) comprises a proximal end (102*a*) and an open distal end (102*b*). The cap part (102) is therewith movably connected to the core part (101) between an open position of the tip seal (10) wherein foam is dispensable and a closed position of the tip seal (10) wherein foam is non-dispensable. The proximal end (102*a*) of the cap part (102) comprises a closure element (1021) for closing off the proximal end (101*a*) of the core portion and a plurality of dispense orifices (1023) arranged around the circumference of the proximal end (102*a*) of the cap portion (102) allowing dispensing of foam. The closure element (1021) and the dispensing orifices (1023) therewith thus have to be arranged in such a way that substantially no ambient air can penetrate into the proximal end (101*a*) of the core part (101) when the tip seal (10) is in its closed position, but allowing foam to be dispensed through the dispensing orifices (1023) when the tip seal (10) is in its open position. Therefore, as can be seen in FIG. 2*b*, the closure element preferably is in the form of a centrally positioned inwardly protruding sealing cap (1021) which extends partially throughout the core part (101) when the tip seal (10) is in its closed position, and as can be also be seen in FIGS. 3*c*, 4*c*, 5*c* and 6*c*, the dispensing orifices (1023) are arranged above this sealing cap (1021), through which substantially no ambient air can penetrate into the proximal end (101*a*) of the core part (101) through these dispensing orifices (1023) when the tip seal (10) is in its closed position.

In order to seal off the proximal end (101*b*) of the core part (101) even better from ambient air, the closure element (1021) comprises one or more sealing elements, in the embodiments as shown in FIGS. 2*b*, 4*c*, 5*c* and 6*c*, in the form of sealing rims (10211) extending at least partially, and in these embodiments completely, around the circumference of the closure element (1021). In the first embodiment of a tip seal (10) according to the invention (see FIGS. 2*b* and 4*c*), the closure element (1021) has three such sealing rims (10211), while the third and fourth embodiment of a tip seal (10) according to the invention (see FIGS. 5*c* and 6*c*) have two such sealing rims (10211).

To be able to stop the movement of the cap part (102) relative to the core part (101) in a direction towards the proximal end (101*a*) of the core part (101) such that the cap part (102) cannot be separated from the core part (101), near the proximal end (101*a*) of the core part (101), the core part (101) is provided with a first stop member (1012) and the cap part (102) is provided with a second stop member (1022), these stop members (1012, 1022) being designed to cooperate together. As can be seen in FIG. 2*a*, the core part (101) preferably has a first stop rim (1012) at its proximal end (101*a*) extending at least partially, and in this embodiment completely, at the outer surface of the core part (101) around the circumference thereof, and the cap part (102) preferably has a second stop rim (1022) extending at least partially, and in this embodiment completely, at the inner surface of the cap part (102) around the circumference thereof. The second stop rim (1022) therewith is designed to hit against the first stop rim (1012), but cannot pass over this first stop rim (1012) applying a normal tearing force to the cap part (102).

Furthermore, in order to avoid accidental or undesired movement of the cap part (102) relative to the core part (101) in a direction towards the distal end (101*b*) of the core part (101), the core part (101) comprises a first movement restriction member (1013) and the cap part comprises a second movement restriction member (1022) that are designed to cooperate together in such a way that the cap part (102) can only move relative to the core part (101) in a direction towards the distal end (101*b*) of the core part (101) when a certain minimal required force is exerted on the cap part (102). More specifically, as can be seen in FIGS. 2*a* and 2*b*, in this embodiment, the core part (101) comprises a first movement restriction rim (1013) as the first stop member and cap part (102) comprises a second movement restriction rim, here the second stop rim (1022) as mentioned above, as the second movement restriction member. This first movement restriction rim (1013) extends at least partially, and in this embodiment completely around the circumference of the core part (101), and is configured such that a force has to be exerted on the cap part (102) to move the first movement restriction rim (1013) over the second stop/movement restriction rim (1022).

As can be seen in FIGS. 2*a* and 2*b*, between the first stop rim (1012) and the first movement restriction rim (1013) of the core part (101), a groove (1014) is arranged extending around at least part, and in this embodiment the complete circumference of the core part (101). The second stop/movement restriction rim (1022) is therewith configured to snap fit into this groove (1014).

As is shown in the FIGS. 2*a* & 2*b*, 3*a*-3*c*, 4*a*-4*c*, 5*a*-5*c* and 6*a*-6*c*, different configurations of the dispensing orifices (1023) with respect to the sealing cap (1021) are possible.

Figure 3A:
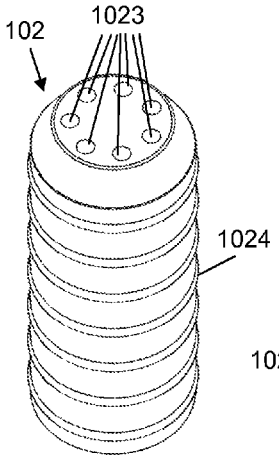
FIG. 3*a* illustrates a perspective front view of the cap part of a second embodiment of a tip seal according to the invention.
Figure 3B:
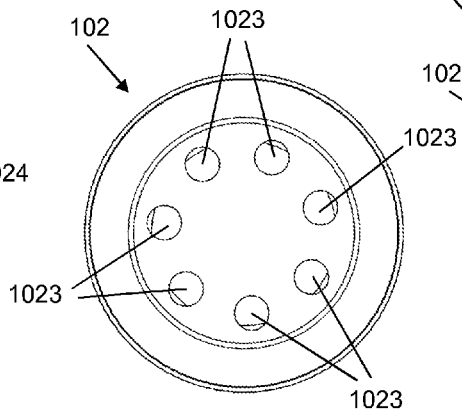
FIG. 3*b* illustrates a top view of the cap part as shown in FIG. 3*a;*
Figure 3C:
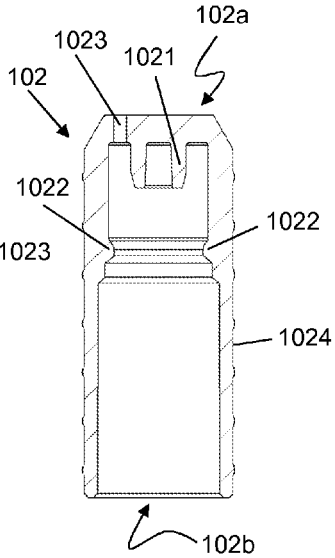
FIG. 3*c* illustrates a cross section of the cap part as shown in FIG. 3*a;*

In FIGS. 3*a*-3*c*, a plurality, in this embodiment 7, round orifices are arranged along the outer circumference of the proximal end (102*a*) of the cap part (102) and around the sealing cap (1021).

Figure 4A:
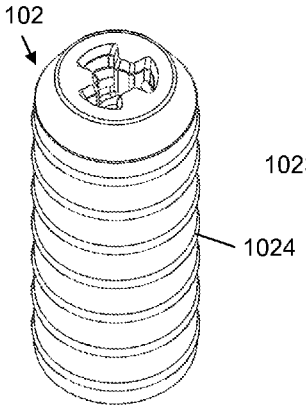
FIG. 4*a* illustrates a perspective front view of the cap part of the first embodiment of the tip seal according to the invention as shown in FIGS. 2*a* and 2*b;*
Figure 4B:
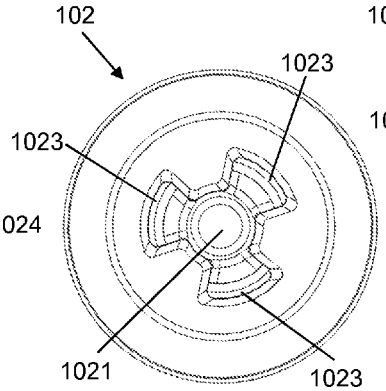
FIG. 4*b* illustrates a top view of the cap part as shown in FIG. 4*a;*
Figure 4C:
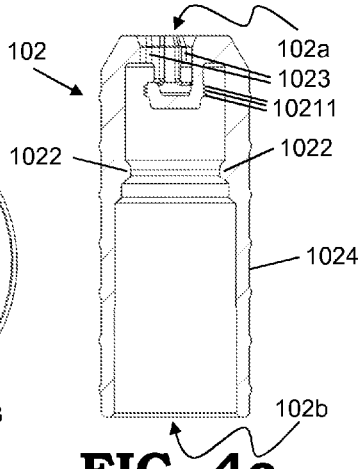
FIG. 4*c* illustrates a cross section of the cap part as shown in FIG. 4*a;*

In FIGS. 4*a*-4*c*, a plurality, in this embodiment 3, triangle-like shaped orifices (1023) extending directly around the sealing cap (1021) are provided.

Figure 5A:
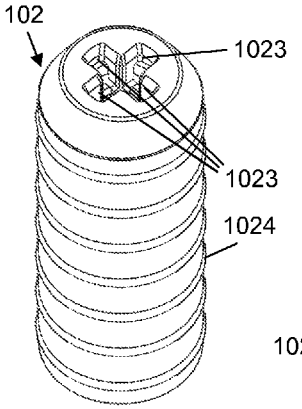
FIG. 5*a* illustrates a perspective front view of the cap part of a third embodiment of a tip seal according to the invention.
Figure 5B:
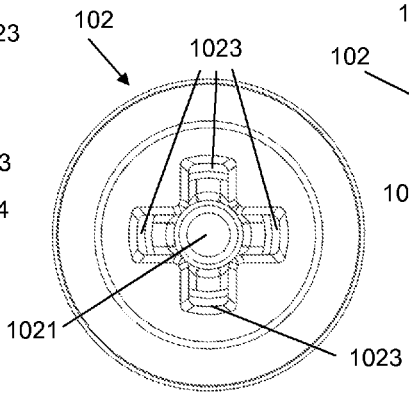
FIG. 5*b* illustrates a top view of the cap part as shown in FIG. 5*a;*
Figure 5C:
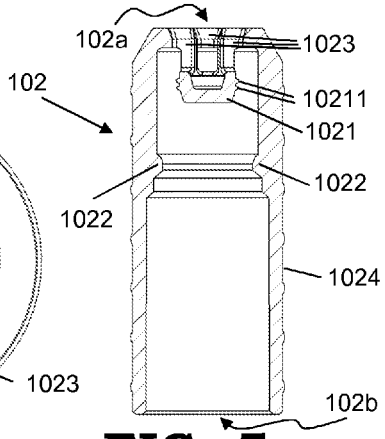
FIG. 5*c* illustrates a cross section of the cap part as shown in FIG. 5*a;*

In FIGS. 5*a*-5*c*, a plurality, in this embodiment 4, square-like shaped orifices (1023) extending directly around the sealing cap (1021) are provided.

Figure 6A:
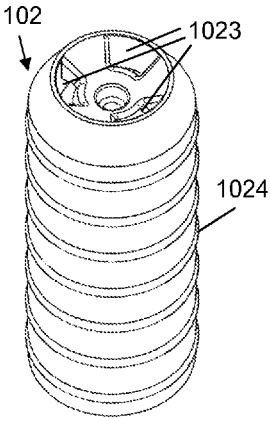
FIG. 6*a* illustrates a perspective front view of the cap part of a fourth embodiment of a tip seal according to the invention.
Figure 6B:
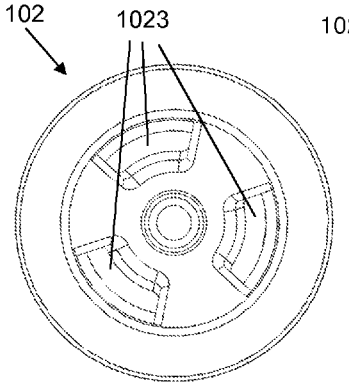
FIG. 6*b* illustrates a top view of the cap part as shown in FIG. 6*a*.
Figure 6C:
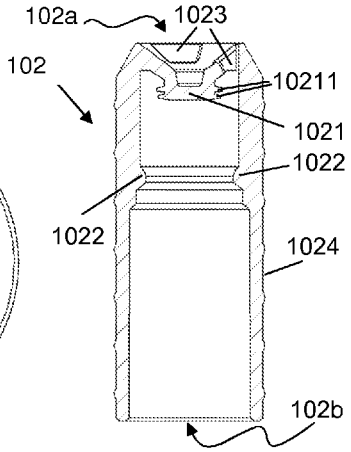
FIG. 6*c* illustrates a cross section of the cap part as shown in FIG. 6*a*.

In FIGS. 6*a*-6*c*, a plurality, in this embodiment 3, oblong orifices (1023) are arranged along the outer circumference of the proximal end (102*a*) of the cap part (102) and around the sealing cap (1021).

Figure 7A:
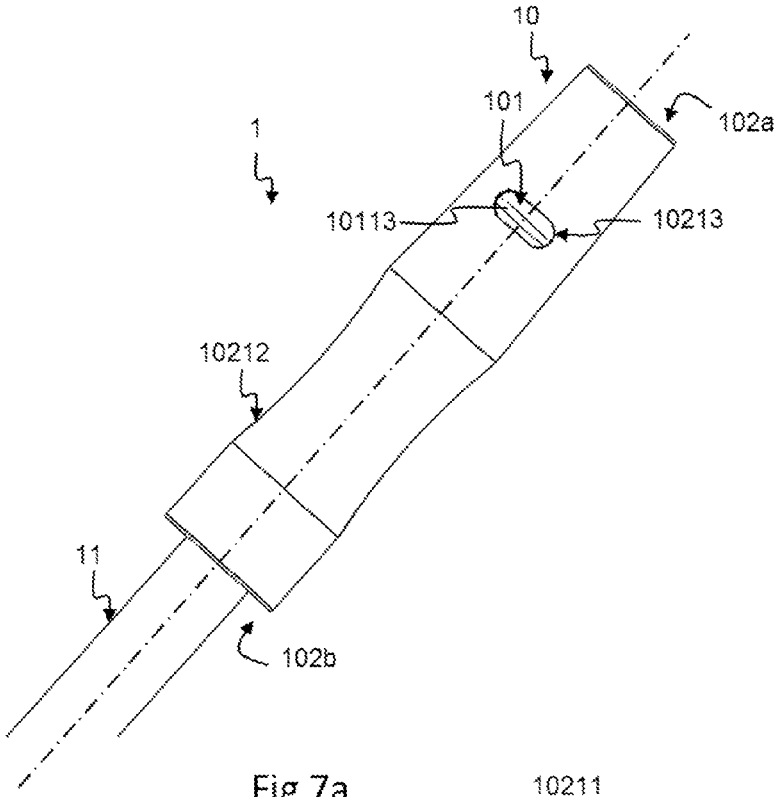
FIG. 7*a*-7*d*, shows different views and sections of a further embodiment similar to that of FIGS. 4*a*-4*c* comprising a position indicator.
Figure 7B:
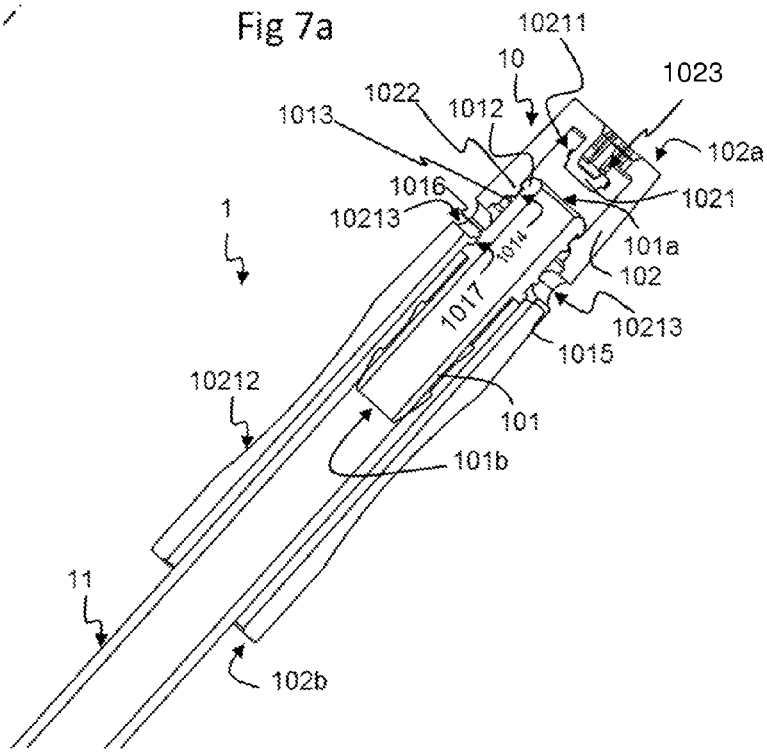
Figure 7C:
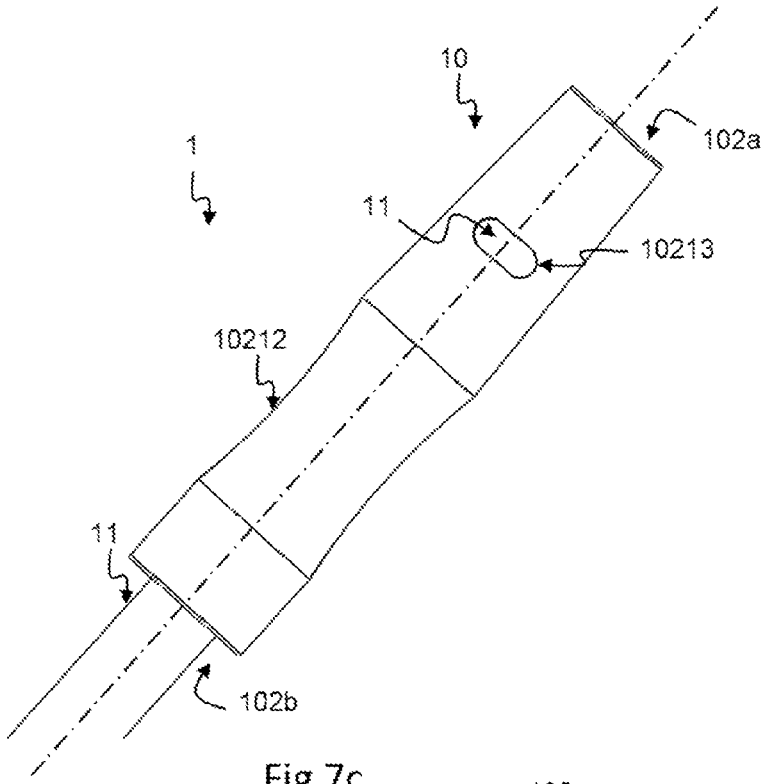

In FIGS. 7*a*-7*d*, a further embodiment similar to that of FIGS. 4*a*-4*c* is shown comprising a position indicator. This means in general a tip seal 10 adapted to dispense a foam when connected to a distal end 11*b* of a tube 11 of an adapter 1 that is configured to be connected to a pressurized dispensing container comprising a viscous foamable solution that is converted into said foam when leaving said container. As explained above, said adapter 1 comprises said tube 11 which at its distal end 11*b* is in connection with said container and at its proximal end 11*a* is connected with said tip seal 10, and which is adapted to convey said foam towards said tip seal 10. Said tip seal 10 comprises a core part 101 and a cap part 102. The core part 101 comprises an at least partially open proximal end 101*a* and an at least partially open distal end 101*b*, wherein said distal end 101*b* of said core part 101 is adapted to be inserted into said tube 11. The cap part 102 extends between its proximal end 102*a* and its distal end 102*b* and comprising at least one dispensing orifice to dispense at its proximal end 102*a* said foam received from said core part 101. Said cap part 102 is movably connected with said core part 101 at said proximal end 101*a* of said core part 101 between an open position of said tip seal 10 wherein said foam is dispensable and a closed position of said tip seal 10 wherein said foam is non-dispensable. As shown in FIGS. 7*a*-7*b*, the core part has a generally tubular shape and is partly inserted into the tube 11 at its distal end 101*b* and partly extending from the tube 11 at its proximal end 101*a*. The longitudinal central axis of the tube 11 and the core part as shown in FIGS. 7*a* and 7*c* substantially coinciding. As further shown the cap part 102 according to this embodiment is a generally tubular shaped cap with its open end at the distal end 102*b* in which the core part 101 is introduced in such a way that also the central longitudinal axis of the core part 101 is substantially aligned with that of the cap part 102 as shown in FIGS. 7*a* and 7C. Additionally, as shown, according to this embodiment also the part of the tube 11 in which the core part is partially inserted, this means at its proximal end 11*a* is at least partially inserted into the tubular shaped cap part 102 such that substantially the longitudinal central axis of the tube 11, core part 101 and cap part 102 are substantially aligned and coinciding.

Figure 7D:
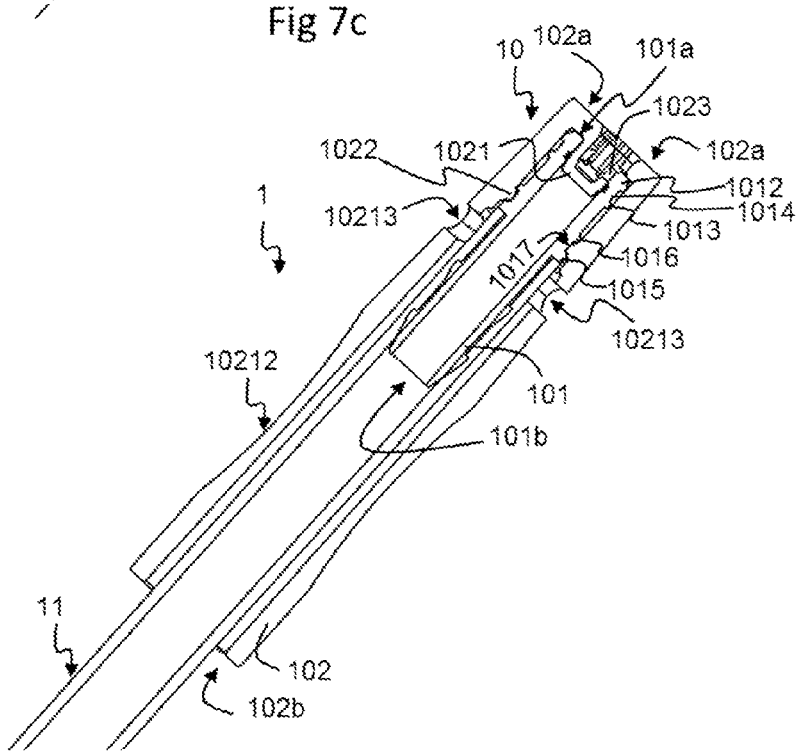

Similar as with the above mentioned embodiments, according to the embodiment of FIGS. 7*a*-7*d*, said cap part 102 comprises a closure element 1021 formed as an inwardly protruding sealing cap 1021, positioned between said proximal end 102*a* and said distal end 102*b*. This means that along the longitudinal central axis of the cap part 102, the closure element 1021 extends from the proximal end 102*a* into the internal hollow of the tubular shaped cap part 102. In the closed position as shown in the view of FIG. 7*c* and the section along the central axis as shown in FIG. 7*d* the closure element 1021 at least partially extends within said core part 101. It is clear that when said tip seal 10 is in its closed position said at least partially open proximal end 101*a* of said core part 101 is closed off by the closure element 1021. It is further also clear that the inwardly protruding sealing cap 1021 of said closure element 1021 of said cap part 102 is completely extracted from within said core part 101 when tip seal is in said open position. Movement from the opened position to the closed position is effected by a substantially linear movement of the tubular shaped cap part 102 with respect to the tubular shaped core part 101 that is introduced in it along their central longitudinal axis.

Also the embodiment of FIGS. 7*a* to 7*b* comprises a plurality of dispensing orifices 1023 extending around said closure element 1021 and configured to dispense said foam at said proximal end 102*a* of said cap part 102. When in the open position, as shown in FIGS. 7*a* and 7*b*, the arrangement of the closure element 1021 with respect to the proximal end 101*a* of the core part 101 is such that it allows for a homogeneous and sufficiently high flow of foam from the proximal end 101*a* of the core part 101 along the closure element 1021 to the plurality of dispensing orifices 10213. As shown, the flow of the foam is not subjected to resistance from any elements protruding inside the tubular shaped core part 101. Also the arrangement of the closure element 1021 at a predetermined distance from the proximal end 101*a* of the core part 101 allows for an efficient and homogeneous outflow of the foam from the core part 101 to the tubular inside of the cap part 102. Further the closure element 1021, as shown is also arranged at a predetermine distance from the proximal end 102*a* of the cap part 102, so that the homogeneous outflow of the foam from the core part 101 along the closure element 1021 through the plurality of dispensing orifices 10213 to the proximal end 102*a* can be maintained optimally. Additionally, the arrangement of the plurality of dispensing orifices 1023 similar as shown with reference to the embodiment of FIG. 3, this means three dispensing orifices 1023 extending directly around the sealing cap 1021 and extending along the direction of the longitudinal central axis between this sealing cap 1021 and a common aperture at the level of the proximal end 102*a* of the sealing cap 101. The even distribution of the plurality of these dispensing orifices 1023 around the circumference of the sealing cap 1021 when viewed in the direction of the central longitudinal axis also allows for an optimal homogenous outflow of the foam.

It is clear that alternative embodiments of the plurality of opening apertures are possible such as for example according to the embodiment of FIG. 5 which also comprises a cap part 102 comprising two or more dispensing orifices 1023 at least partly extending between said closure element 1021 and said proximal end 102*a* of said cap part (102). Further alternatives are possible with two or more dispensing orifices 1023 in general arranged at the proximal end 102*a* of the cap part 102. Both a plurality of such dispensing orifices 1023 that merge at the level of the proximal end 102*a* as described above, as well as alternative embodiments with dispensing orifices 1023 that remain separated at the level of the distal end 102, such as for example shown in FIGS. 6*a-c* and 3*a-c* are possible.

As will be explained in more detail below the embodiment of said tip seal 10 comprises movement restrictors 1012, 1013, 1014, 1022 configured to releasably secure the cap part 102 on the core part 101 in the open position. This is important as in the context of dispensing moisture curable foam it is required to guarantee that the cap part 102 securely remains in the open position in order to assure the homogeneous outflow of said foam, even when the cap part is subjected to a force in in the direction of the closed position.

According to the embodiment shown in FIG. 7*a-d* said movement restrictors comprise a first movement restriction rim 1013 on said core part 101 extending around at least part of the circumference of said core part 101; and a second movement restriction rim 1022 on said cap part 102 extending around at least part of the circumference of said cap part 102, Said first and second movement restriction rim 1013, 1022 being positioned with respect to each other such that the cap part 102 is secured in said open position when said second movement restriction rim 1022 of the cap part 102 is positioned between said first movement restriction rim 1013 of the core part 102 and said proximal end 102*a* of the core part 102, Said first and second movement restriction rims 1013, 1022 being configured such that movement of said second movement restriction rim 1022 of the cap part 102 from said open position past said first movement restriction rim 1013 of said core part 101 second movement rest is only possible when a force is exerted on said cap part 102 which is large enough to move said second movement restriction rim 1022 over said first movement restriction rim 1013 when a force is exerted on said cap part 102 along said direction towards said closed position that exceeds a predetermined minimal holding force.

It is clear that alternative embodiments are possible, as long as in general said movement restrictors comprise at least one movement restriction member 1012, 1013, 1014 on said core part 101 and at least one movement restriction member 1022 on said cap part 102. Said at least one movement restriction member 1012, 1013 of the core part 101 being designed to cooperate together with said at least one movement restriction member 1022 of said cap part 102 such that said cap part 102 can only be released from said open position by a movement of said cap part 102 relative to said core part 101 in a direction towards the closed position when a force is exerted on said cap part 102 along said direction towards said closed position that exceeds a predetermined minimal holding force.

According to the embodiment shown in FIG. 7*a-d* said movement restrictors further comprise at least one first stop rim 1012 on said core part 101 extending around at least part of the circumference of said core part 101 and located between said first movement restriction rim 1013 and said proximal end 101*a*, and configured such that the cap part 102 is releasably secured in the open position when said second movement rim 1022 of said cap part 102 is positioned between said first movement restriction rim 1013 and said second movement restriction rim 1012 of said core part 101.

As further shown said movement restrictors further comprise a groove 1014 on said core part 101 extending around at least part of the circumference of said core part 101 and located between said first stop rim 1012 and said first movement restriction rim 1013, and configured such that the cap part 102 is releasably secured in the open position when said second movement restriction rim 1022 of said cap part is snap fit into said groove 1014 on said core part 101.

As further shown, according the embodiment of FIG. 7*a*-7*d* the core part 101 further comprises an open position indicator 10113; and the cap part 102 further comprises at least one opening 10213 arranged in the side wall between the proximal end 102*a* and the distal end 102*b*, said at least one opening 10213 being positioned such that said open position indicator 1016 is only visible when the cap part 102 is releasably secured in the open position by the movement restrictors 1012, 1013, 1014, 1022. As shown, said open position indicator 10113 comprises the movement restrictor 1016 as will be explained in further detail below, however according to alternative embodiment any other suitably positioned movement restrictor 1012, 1013, 1015, 1016 arranged on the cap part 102. This allows the operator to verify that the cap part is correctly secured into the open position before dispensing the foam, thus avoiding the risk during after engaging in dispensing of the foam and the cap part interfering with the homogeneous flow of the foam because it is pushed towards the closed position when it was not secured correctly in the open position As further shown, according the embodiment of FIG. 7*a*-7*d* said tip seal 10 comprises further movement restrictors 1015, 1016, 1017, 1022 configured to releasably secure the cap part 102 on the core part 101 in the closed position. These movement restrictors, as shown are formed as two movement restriction rims 1015, 1016 and a groove 1017 in between these rims 1015, 1016 on the core part 101 cooperating with the first movement restriction rim 1012 of the cap part in a similar way as the movement restrictors 1012, 1013, 1014 and 1022 described above.

As further shown, according the embodiment of FIG. 7*a*-7*d* the core part 101 further comprises a closed position indicator. Said at least one opening 10213 in said cap part being positioned such that said closed position indicator is only visible when the cap part 102 is releasably secured in the closed position by the further movement restrictors 1015, 1016, 1017, 1022. As shown according to this embodiment the closed position indicator is formed by means of the tube 11 covering the core part 101. When the tube 11 is visible through the opening 10213 instead of the core part 1012 this thus forms an indication that the cap part is securely locked in the closed position.

It is clear that alternative embodiments for the closed position indicator and the open position indicator are possible next to the ones described above. There could for example be two differently coloured regions applied to the tube 11 and/or the core part 101 that respectively only become visible through the opening 10213 in the open and closed position.

Preferably, as shown said closure element 1021 comprises one or more sealing elements 10211 that are adapted to seal off said proximal end 101*a* of said core part 101, As shown said sealing elements comprise one or more sealing rims 10211 extending around at least part of the circumference of said closure element 1021. Said sealing rims are for example manufactured from flexible polyolefine, this is advantageous, especially for guaranteeing a secure sealing in the context of a dispenser of moisture curable foam. In such an application it is important that the foam is sealed against air and humidity as this affects the shelf life of the product. It is additionally required to withstand the pressure build up generated by the foam remaining in the tube 11 after dispensing said foam in order to prevent post-dripping, which means that the remaining foam inside this tube 11 expands and risks being released from the proximal end of the tip seal inadvertently, thereby releasing said foam in an unintended and uncontrolled way, for example in during transport or in a temporary storage environment. Further the embodiment of FIGS. 7*a*-*d* comprises an indentation 10212 on the outer surface of the tubular shape of the cap part 102 in order to allow for a secure grip for the operator when moving the cap part 102 relative to the core part 101 for moving it from the closed to the open position. It is clear that still further alternatives next to the ribbed outer surface 1024 and this indentation 10212 are possible for enabling a better manipulation of the cap part 102.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A tip seal for an adapter configured to be connected to a pressurized dispensing container comprising a viscous foamable solution that is converted into foam when leaving said container, wherein said adapter comprises a tube having a distal end connected to said container and a proximal end connected to said tip seal, said tube being adapted to convey said foam towards said tip seal, said tip seal comprising:

a core part including an at least partially open proximal end and an at least partially open distal end, wherein said distal end of said core part is adapted to be inserted into said tube; and a cap part including a proximal end and a distal end, wherein said cap part includes at least one dispensing orifice at its proximal end to dispense said foam, said foam being received from said core part, wherein said cap part is movably connected with said core part at said proximal end of said core part between an open position of said tip seal in which said foam is dispensable and a closed position of said tip seal in which said foam is non-dispensable, wherein said cap part further comprises:

a closure element formed as an inwardly protruding sealing cap, said closure element being positioned between said proximal end and said distal end of said cap part, said closure element extending at least partially within said core part when said tip seal is in its closed position such that said at least partially open proximal end of said core part is closed off, and a plurality of dispensing orifices extending around said closure element and configured to dispense said foam at said proximal end of said cap part, wherein said core part further comprises an open position indicator, wherein said cap part further comprises at least one opening arranged in a side wall of said cap part between the proximal end and the distal end of said cap part, said at least one opening being positioned such that said open position indicator is only visible when the cap part is releasably secured in the open position, and wherein said position indicator includes an indicator movement restriction rim included in said core part, the indicator movement restriction rim being configured to be visible when the cap part is releasably secured in the open position.

2. The tip seal according to claim 1, wherein said tip seal includes a first movement restriction element configured to maintain the tip seal in an open position while said foam is dispensed, said first movement restriction element including a first movement restriction rim included in said core part and a second movement restriction rim included in said cap part.

3. Tip seal according to claim 2, wherein said tip seal includes a second movement restriction element configured to maintain the tip seal in a closed position, said second movement restriction element including the indicator movement restriction rim, which is a third movement restriction rim included in said core part, said third movement restriction rim being configured to engage said second movement restriction rim included in said cap part to maintain the tip seal in the closed position.

4. Tip seal according to claim 3, wherein said core part further comprises a closed position indicator, said at least one opening in said cap part being configured to be positioned such that said closed position indicator is only visible when said cap part is releasably secured in said closed position by said second movement restriction element.

5. The tip seal according to claim 3, wherein said second movement restriction element includes a fourth movement restriction rim included in said core part.

6. The tip seal according to claim 5, wherein said second movement restriction element includes a groove formed in said core part between said third movement restriction rim and said fourth movement restriction rim.

7. Tip seal according to claim 1, wherein said inwardly protruding sealing cap of said closure element is configured to be completely extracted from within said core part when said tip seal is in said open position.

8. Tip seal according to claim 1, wherein said cap part comprises two or more dispense orifices at said proximal end of said cap part.

9. Tip seal according to claim 1, wherein said cap part comprises two or more dispensing orifices at least partly extending between said closure element and said proximal end of said cap part.

10. Tip seal according to claim 2, wherein said first movement restriction rim extends around at least part of the outer circumference of said core part, and said second movement restriction rim extends around at least part of the inner circumference of said cap part.

11. The tip seal according to claim 10, wherein said first and second movement restriction rims are positioned with respect to each other such that the cap part is secured in said open position when said second movement restriction rim of the cap part is positioned between said first movement restriction rim and said proximal end of the core part.

12. The tip seal according to claim 10, wherein said first and second movement restriction rims are configured such that movement of said second movement restriction rim from said open position past said first movement restriction rim is only possible when a force exceeding a predetermined minimal holding force is exerted on said cap part which is large enough to move said second movement restriction rim over said first movement restriction rim along said direction towards said closed position.

13. Tip seal according to claim 12, wherein said first movement restriction element further comprises: at least one first stop rim on said core part extending around at least part of the circumference of said core part and located between said first movement restriction rim and said proximal end of said core part, and wherein said tip seal is configured such that the cap part is releasably secured in the open position when said second movement restriction rim of said cap part is positioned between said first movement restriction rim and said first stop rim on said core part.

14. Tip seal according to claim 13, wherein said first movement restriction element further comprises a groove on said core part extending around at least part of the outer circumference of said core part and located between said first stop rim and said first movement restriction rim, and wherein said tip seal is configured such that the cap part is releasably secured in the open position when said second movement restriction rim of said cap part is snap fit into said groove on said core part.

15. The tip seal according to claim 1, wherein said closure element comprises one or more sealing elements that are adapted to seal off said proximal end of said core part, said sealing elements comprising one or more sealing rims extending around at least part of the circumference of said closure element.

16. The tip seal according to claim 15, wherein said sealing rims are manufactured from flexible polyolefine.

17. An adapter configured to be connected to a pressurized dispensing container comprising a viscous foamable solution that is converted into foam when leaving said container, wherein said adapter comprises:

a valve adapted to convert said viscous foamable solution into foam;

a lever part which is adapted to be connected with said valve and which is adapted to actuate said valve when being operated;

a tube which at its distal end is connected to said lever part; and a tip seal provided at a distal end of the tub, wherein the tip seal includes a core part including an at least partially open proximal end and an at least partially open distal end, wherein said distal end of said core part is adapted to be inserted into said tube, and a cap part including a proximal end and a distal end, wherein said cap part includes at least one dispensing orifice at its proximal end to dispense said foam, said foam being received from said core part, wherein said cap part is movably connected with said core part at said proximal end of said core part between an open position of said tip seal in which said foam is dispensable and a closed position of said tip seal in which said foam is non-dispensable, wherein said cap part further comprises:

a closure element formed as an inwardly protruding sealing cap, said closure element being positioned between said proximal end and said distal end of said cap part, said closure element extending at least partially within said core part when said tip seal is in its closed position such that said at least partially open proximal end of said core part is closed off, and a plurality of dispensing orifices extending around said closure element and configured to dispense said foam at said proximal end of said cap part, wherein said core part further comprises an open position indicator, wherein said cap part further comprises at least one opening arranged in a side wall of said cap part between the proximal end and the distal end of said cap part, said at least one opening being positioned such that said open position indicator is only visible when the cap part is releasably secured in the open position, and wherein said position indicator includes an indicator movement restriction rim included in said core part, the indicator movement restriction rim being configured to be visible when the cap part is releasably secured in the open position.

* * * * *